US011289052B2

(12) United States Patent
Qin

(10) Patent No.: US 11,289,052 B2
(45) Date of Patent: Mar. 29, 2022

(54) IMAGE QUALITY OPTIMIZATION METHOD BASED ON LOCAL DIMMING, APPARATUS, AND COMPUTER READABLE STORAGE MEDIUM

(71) Applicant: SHENZHEN SKYWORTH-RGB ELECTRONIC CO., LTD., Shenzhen (CN)

(72) Inventor: Jilei Qin, Shenzhen (CN)

(73) Assignee: SHENZHEN SKYWORTH-RGB ELECTRONIC CO., LTD., Shenzhen (CN)

( * ) Notice: Subject to any disclaimer, the term of this patent is extended or adjusted under 35 U.S.C. 154(b) by 0 days.

(21) Appl. No.: 17/028,110

(22) Filed: Sep. 22, 2020

(65) Prior Publication Data

US 2021/0005162 A1 Jan. 7, 2021

Related U.S. Application Data

(63) Continuation of application No. PCT/CN2018/101739, filed on Aug. 22, 2018.

(30) Foreign Application Priority Data

Jun. 13, 2018 (CN) ..... 201810612299.4

(51) Int. Cl.

| | |
|---|---|
| ***G09G 3/34*** | (2006.01) |
| ***G09G 5/10*** | (2006.01) |
| ***G09G 3/36*** | (2006.01) |

(52) U.S. Cl.

CPC ..... *G09G 5/10* (2013.01); *G09G 3/3607* (2013.01); *G09G 2320/064* (2013.01);

(Continued)

(58) Field of Classification Search

None

See application file for complete search history.

(56) References Cited

U.S. PATENT DOCUMENTS

2014/0071032 A1 3/2014 Kimura
2014/0232760 A1 8/2014 Oda (Continued)

FOREIGN PATENT DOCUMENTS

CN 101494025 A 7/2009
CN 201374865 Y 12/2009

(Continued)

OTHER PUBLICATIONS

First Office Action in counterpart Chinese Application No. 201810612299.4, dated Nov. 11, 2019.

(Continued)

*Primary Examiner* — Amr A Awad
*Assistant Examiner* — Donna V Bocar
(74) *Attorney, Agent, or Firm* — Westbridge IP LLC

(57) ABSTRACT

An image quality optimization method based on local dimming includes: based on an input image signal, calculating a PWM duty cycle of a current image signal corresponding to each of backlight regions; comparing a preset first PWM duty cycle and a preset second PWM duty cycle with each PWM duty cycle of the current image signal corresponding to each of the backlight regions to determine whether there exists a high backlight region and a low backlight region in the backlight regions; in determining that there exists the high backlight region and the low backlight region, decreasing a PWM duty cycle of the low backlight region to decrease an output current, and increasing a PWM duty cycle of the high backlight region to increase an output current, thereby increasing a contrast of the current image (Continued)

signal. The present application also provides related apparatus and computer readable storage medium.

13 Claims, 3 Drawing Sheets

(52) U.S. Cl.
CPC . *G09G 2320/0646* (2013.01); *G09G 2320/08* (2013.01); *G09G 2354/00* (2013.01)

(56) References Cited

U.S. PATENT DOCUMENTS

| | | | | |
|---|---|---|---|---|
| 2015/0009249 | A1 | 1/2015 | Kudo et al. | |
| 2016/0117999 | A1* | 4/2016 | Hayashi | G09G 3/3406 345/691 |
| 2016/0335957 | A1 | 11/2016 | Fu et al. | |
| 2017/0061896 | A1 | 3/2017 | Zhang et al. | |
| 2018/0120642 | A1* | 5/2018 | Zhang | G02F 1/133611 |
| 2018/0180941 | A1* | 6/2018 | Zhang | G02F 1/133602 |
| 2020/0195878 | A1* | 6/2020 | Ray | H04N 13/139 |

FOREIGN PATENT DOCUMENTS

| | | | |
|---|---|---|---|
| CN | 102770899 | A | 11/2012 |
| CN | 105047142 | A | 11/2015 |
| CN | 106101594 | A | 11/2016 |
| CN | 106652920 | A | 5/2017 |
| EP | 2148318 | A2 | 1/2010 |

OTHER PUBLICATIONS

International Search Report and Written Opinion in corresponding PCT Application No. PCT/CN2018/101739, dated Feb. 27, 2019.
Examination Report in counterpart Indian Patent Application No. 202027052690, dated Dec. 22, 2021.
Supplementary European Search Report in counterpart European Patent Application No. 18922702.8, dated Jan. 12, 2022.

* cited by examiner

IMAGE QUALITY OPTIMIZATION METHOD BASED ON LOCAL DIMMING, APPARATUS, AND COMPUTER READABLE STORAGE MEDIUM

CROSS REFERENCE TO RELATED APPLICATIONS

The present application is a continuation application of International Application No. PCT/CN2018/101739, filed on Aug. 22, 2018, which claims the benefit of Chinese patent application filed with the National Intellectual Property Administration on Jun. 13, 2018, with the application number 201810612299.4 and the Title "Image Quality Optimization Method Based On local Dimming, Device, Equipment and Storage Medium", the entire contents of which are hereby incorporated by reference.

TECHNICAL FIELD

The disclosure relates to the field of image display technology, and in particular, to an image quality optimization method based on local dimming, an apparatus, and a computer-readable storage medium thereof.

BACKGROUND

In the field of video display, the display of the liquid crystal display device is based on the Pixel Value (pixel values) constituted by RGBs of the liquid crystal display unit diodes and BackLight Value (backlight values) of light strips. The traditional LCD displays have certain limitations on display contrast and energy efficiency. In order to pursue better picture quality performance and lower power consumption, and together with that the edge-lit and direct-lit backlight technology is becoming more and more mature, it evolves from the original 0-D Dimming, 1-D Dimming to 2-D Dimming (Local Dimming) technology which has realized mass production in the current.

Local Dimming (regional dimming) technology is to divide the original LCD panel backlight to multiple regions (areas), and separately control the backlight value for each region. The hardware has a multi-region backlight strip design, and the software controls the driving current of the strips by controlling the regional backlight current, thus to control the brightness of the backlight. There are more and more backlight regions, and the controlling of the backlight becomes more and more refined compared to the original simple backlight control. The image quality performance is also greatly improved. However, the backlight multi-region control itself brings an increase in costs of hardware light strips and power supply.

SUMMARY

The main purpose of the present application is to provide an image quality optimization method, apparatus and computer-readable storage medium based on local dimming, aiming to solve the technical problems of low local contrast and high power consumption in the existing local dimming technology.

To achieve the above object, the present application provides an image quality optimization method based on local dimming. The image quality optimization method based on local dimming includes the following steps:

based on an input image signal, calculating a PWM duty cycle of a current image signal corresponding to each of backlight regions;

comparing a preset first PWM duty cycle and a preset second PWM duty cycle with each PWM duty cycle of the current image signal corresponding to each of the backlight regions to determine whether there exists a high backlight region and a low backlight region in the backlight regions;

in determining that there exists the high backlight region and the low backlight region, decreasing a PWM duty cycle of the low backlight region to decrease an output current to the low backlight region, and increasing a PWM duty cycle of the high backlight region to increase an output current to the high backlight region, thereby increasing a contrast of the current image signal.

Optionally, after "based the input image signal, calculating a PWM duty cycle of a current image signal corresponding to each of backlight regions", the method further includes:

comparing preset backlight data of a designated backlight region with backlight data corresponding to the current image signal in the designated backlight region;

in determining that the preset backlight data of the designated backlight region is consistent with the backlight data corresponding to the current image signal in the designated backlight region, determining whether a PWM duty cycle of the current image signal in surrounding backlight regions around the designated backlight region is less than a preset third PWM duty cycle;

in determining that the PWM duty cycle of the current image signal in the surrounding backlight regions around the designated backlight region is less than the preset third PWM duty cycle, increasing a PWM duty cycle and RGB pixel values of the designated backlight region to increase an output current to the designated backlight region, thereby to increase the brightness of the current image signal.

Optionally, "decreasing a PWM duty cycle of the low backlight region to decrease an output current to the low backlight region, and increasing a PWM duty cycle of the high backlight region to increase an output current to the high backlight region" includes:

decreasing the PWM duty cycle of the low backlight region and increasing the PWM duty cycle of the high backlight region;

based on a preset first mathematical relationship between PWM duty cycles and backlight powers, obtaining a decreased amount of backlight power of the low backlight region and an increased amount of backlight power of the high backlight region;

in determination that the increased amount of backlight power of the high-backlight region meets a preset condition, based on a preset second mathematical relationship between the PWM duty cycles and output currents, calculating an output current corresponding to the low backlight region after the backlight power of the low-backlight region is decreased and an output current corresponding to the high backlight region after the backlight power of the high backlight region is increased;

where, it is assumed that a difference between a total tolerated limit backlight power and a current total backlight power of all the backlight regions is P1, the decreased amount of backlight power of the low backlight region is P2, the increased amount of backlight power of the high backlight region is P3, and a tolerated limit backlight power of the high backlight region is P4, the preset condition is that: P3 is less than the sum of P1 and P2 and P3 is less than P4.

Optionally, "increasing a PWM duty cycle and RGB pixel values of the designated backlight region" includes:

increasing the PWM duty cycle of the designated backlight region, thereby the output current to the designated backlight region exceeding a set current value;

increasing the RGB pixel values of the designated backlight region to the maximum RGB pixel values, thereby the RGB pixel values of the designated backlight region matching the output current to the designated backlight region.

Optionally, "based on an input image signal, calculating a PWM duty cycle of a current image signal corresponding to each of backlight regions" includes:

coding and parsing the input image signal according to a division of the backlight regions to obtain an average gray value of each of the backlight regions;

based on the average gray value of each of the backlight regions, and mapping relationships between average gray values and backlight values, obtaining a backlight value of each of the backlight regions;

based on the backlight value of each of the backlight regions and preset mapping relationships between backlight values and PWM duty cycles, obtaining the PWM duty cycle corresponding to each of the backlight regions.

Further, in order to achieve the above purpose, the present application also provides an image quality optimization device based on local dimming. The image quality optimization device based on local dimming includes:

a duty cycle calculation module configured to calculate a PWM duty cycle of a current image signal corresponding to each of backlight regions based on an input image signal;

a region comparison module configured to compare a preset first PWM duty cycle and a preset second PWM duty cycle with the PWM duty cycle of the current image signal corresponding to each of the backlight regions to determine whether there exists a high backlight region and a low backlight region in the backlight regions;

a contrast adjustment module is configured to decrease a PWM duty cycle of the low backlight region to decrease an output current to the low backlight region, and increasing a PWM duty cycle of the higher backlight region to increase an output current to the high backlight region, in respond to the determination that there exists the high backlight region and the low backlight region, to increase a contrast of the current image signal.

Optionally, the image quality optimization device based on local dimming further includes:

an image recognition module configured to compare preset backlight data corresponding to a designated backlight region with backlight data corresponding to the current image signal in the designated backlight region, and determine whether a PWM duty cycle of the current image signal in surrounding backlight regions around the designated backlight region is less than a preset third PWM duty cycle in responding to a determination that the preset backlight data of the designated backlight region is consistent with the backlight data corresponding to the current image signal in the designated backlight region;

a brightness adjustment module configured to increase a PWM duty cycle and RGB pixel values of the designated backlight region to increase an output current, so as to increase the brightness of a part of the current image signal in the designated backlight region, in responding to a determination that the PWM duty cycle of the current image signal in the surrounding backlight regions around the designated backlight region is less than the preset third PWM duty cycle.

Optionally, the contrast adjustment module includes:

an adjustment unit configured to decrease the PWM duty cycle of the low backlight region and increase the PWM duty cycle of the high backlight region;

a first calculation unit configured to obtain a decreased amount of backlight power of the low backlight region and an increased amount of backlight power of a high backlight region based on a first mathematical relationship between preset PWM duty cycles and backlight powers;

a second calculation unit configured to calculate an output current corresponding to the low backlight region after the backlight power of the low-backlight region is decreased and an output current corresponding to the high backlight region after the backlight power of the high backlight region is increased based on a second mathematical relationship between the preset PWM duty cycles and output currents, in responding to a determination that the increased amount of backlight power in the high-backlight region meets a preset condition;

where, it is assumed wherein, it is assumed that a difference between a total tolerated limit backlight power and a current total backlight power of all the backlight regions is P1, the decreased amount of backlight power of the low backlight region is P2, the increased amount of backlight power of the high backlight region is P3, and a tolerated limit backlight power of the high backlight region is P4, the preset condition is that: P3 is less than the sum of P1 and P2 and P3 is less than P4

Further, in order to achieve the above purpose, the present invention also provides an image display apparatus, the image display apparatus includes a memory, a processor, and an image quality optimization program based on local dimming stored in the memory and executable by the processor, when the image quality optimization program based on local dimming is executed by the processor, the steps of the image quality optimization method based on local dimming as described above are carried out.

Further, in order to achieve the above object, the present invention also provides a computer-readable storage medium storing an image quality optimization program based on local dimming. When the image quality optimization program based on local dimming is executed by a processor, the steps of the image quality optimization method based on local dimming described above are carried out.

The application improves a contrast of an image by decreasing an output current to the low backlight region and increasing an output current to the high backlight region to adjust the brightnesses of the backlight regions, and compensates the high backlight region with the reduced power consumption reduced by reducing the output current of the low backlight region In this way, the low overall power consumption under the premise of high image contrast is realized, the cost in hardware light strips and power supply is saved, and the stability of the hardware system is ensured.

The implementation, functional characteristics and advantages of the present application will be further described in combination with the embodiments and with reference to the drawings.

DETAILED DESCRIPTION OF THE EMBODIMENTS

It should be understood that the specific embodiments described herein are only used to explain the present invention and are not intended to limit the present invention.

The invention provides an image display apparatus.

Figure 1:
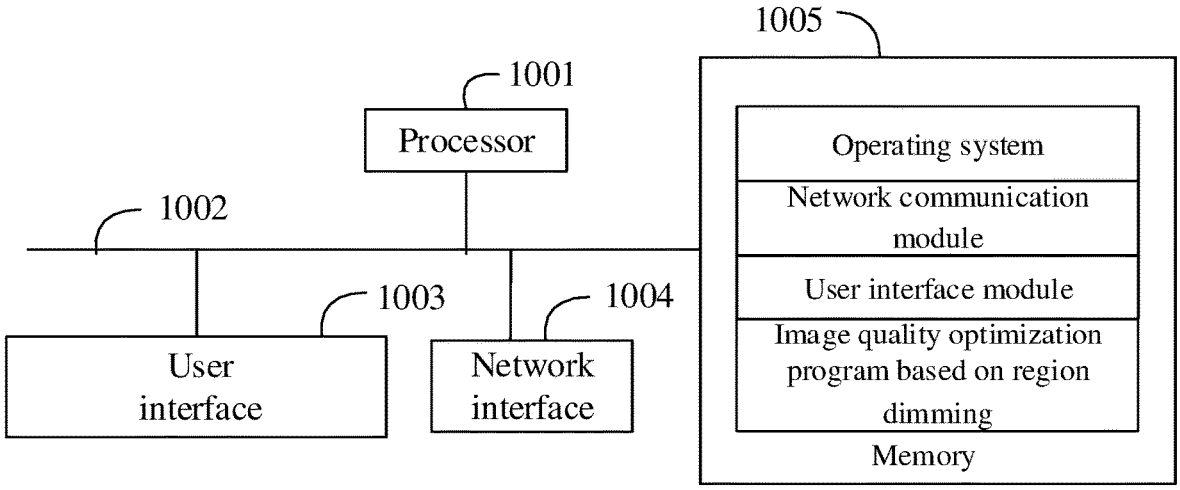
FIG. 1 is a schematic structural diagram of a hardware operating environment involved in embodiments of an image display apparatus according to the present invention.

Referring to FIG. 1, FIG. 1 is a schematic structural diagram of a hardware operating environment involved in embodiments of the image display apparatus according to the present invention.

The image display apparatus of the present invention specifically refers to a device that performs image display in a backlight driving mode, such as a home appliance display device, a mobile handheld device, a monitoring and airborne device, an aviation flat panel display device, or the like.

As shown in FIG. 1, the image display apparatus may include: a processor 1001, such as a CPU, a communication bus 1002, a user interface 1003, a network interface 1004, and a memory 1005. Among them, the communication bus 1002 is used to implement connection and communication between these components. The user interface 1003 may include a display screen (Display), an input unit such as a keyboard (Keyboard), and the user interface 1003 may optionally further include a standard wired interface and a wireless interface. The network interface 1004 may optionally include a standard wired interface and a wireless interface (such as a WI-FI interface). The memory 1005 may be a high-speed RAM memory, or a stable memory (non-volatile memory), such as a disk memory. The memory 1005 may optionally be a storage device independent of the foregoing processor 1001. It should be noted that the processor 1001 is installed in the image display apparatus in the form of embedded chips.

Those skilled in the art can understand that the hardware structure of the image display apparatus shown in FIG. 1 does not constitute a limitation on the image display apparatus, and may include more or fewer components than those illustrated, or a combination of certain components, or with a different arrangement of components.

As shown in FIG. 1, the memory 1005 as a computer-readable storage medium may include an operating system, a network communication module, a user interface module, and an image quality optimization program based on local dimming. Among them, the operating system is a program that manages and controls the image display apparatus and software resources, and supports the operation of the network communication module, the user interface module, the image quality optimization program based on local dimming, and other programs or softwares, the network communication module is used to manage and control the network interface 1004. The user interface module is used to manage and control the user interface 1003.

In the hardware structure of the image display apparatus shown in FIG. 1, the network interface 1004 is mainly used to connect to a background system and perform data communication with the background system. The user interface 1003 is mainly used to connect to the client (user terminal) and perform data communication with the client. The image display apparatus calls the image quality optimization program based on local dimming stored in the memory 1005 through the processor 1001, and performs the following operations:

based on an input image signal, calculating a PWM (pulse width modulation) duty cycle of the current image signal corresponding to each of backlight regions;

comparing a preset first PWM duty cycle and a preset second PWM duty cycle with each PWM duty cycle to determine whether there exists a high backlight region and a low backlight region in the backlight regions;

in determining that there exists the high backlight region and the low backlight region, decreasing a PWM duty cycle of the low backlight region to decrease an output current to the low backlight region, and increasing a PWM duty cycle of the high backlight region to increase an output current, so as to increase a contrast of the current image signal.

Further, the image display apparatus calls the image quality optimization program based on local dimming stored in the memory 1005 through the processor 1001 and further performs the following operations:

comparing preset backlight data of a designated backlight region with backlight data corresponding to the current image signal in the designated backlight region;

in determining that the preset backlight data of the designated backlight region is consistent with the backlight data corresponding to the current image signal in the designated backlight region, determining whether a PWM duty cycle of the current image signal in surrounding backlight regions around the designated backlight region is less than a preset third PWM duty cycle;

in determining that the PWM duty cycle of the current image signal in the surrounding backlight regions around the designated backlight region is less than the preset third PWM duty cycle, increasing a PWM duty cycle and RGB pixel values of the designated backlight region to increase an output current, thereby to increase the brightness of the current image signal.

Further, the image display apparatus calls the image quality optimization program based on local dimming stored in the memory 1005 through the processor 1001 and further performs the following operations:

decreasing the PWM duty cycle of the low backlight region and increasing the PWM duty cycle of the high backlight region;

based on a preset first mathematical relationship between PWM duty cycles and backlight powers, obtaining a decreased amount of backlight power of the low backlight region and an increased amount of backlight power of the high backlight region;

in determination that the increased amount of backlight power of the high-backlight region meets a preset condition, based on a preset second mathematical relationship between the PWM duty cycles and output currents, calculating an output current corresponding to the low backlight region after the backlight power of the low-backlight region is decreased and an output current corresponding to the high backlight region after the backlight power of the high backlight region is increased;

among them, it is assumed that a difference between a total tolerated limit backlight power and a current total backlight power of all backlight regions is P1, the decreased amount of backlight power of the low backlight region is P2, the increased amount of backlight power of the high backlight region is P3, and a tolerated limit backlight power of the high backlight region is P4, the preset condition is that: P3 is less than the sum of P1 and P2 and P3 is less than P4.

Further, the image display apparatus calls the image quality optimization program based on local dimming stored in the memory 1005 through the processor 1001 and further performs the following operations:

increasing the PWM duty cycle of the designated backlight region, so that the output current to the designated backlight region exceeds a set current value;

increasing RGB pixel values of the designated backlight region to the maximum RGB pixel values, so that the RGB pixel values of the designated backlight region matches the output current to the designated backlight region.

Further, the image display apparatus calls the image quality optimization program based on local dimming stored in the memory 1005 through the processor 1001 and further performs the following operations:

coding and parsing the input image signal according to a division of the backlight regions to obtain an average gray value of each backlight region;

based on the average gray value of each backlight region, and mapping relationships between average gray values and backlight values, obtaining a backlight value of each backlight region;

based on the backlight value of each backlight region, and preset mapping relationships between backlight values and PWM duty cycles, obtaining a PWM duty cycle corresponding to each backlight region.

Based on the above hardware operating environment of the image display apparatus of the present invention, the following embodiments of the image quality optimization method based on local dimming of the present invention are provided.

In the present invention, local dimming refers to the local dimming technology, which refers to a technology in which an LCD TV system divides an image signal into several regions, analyzes and calculates an image brightness of each region, and then automatically controls a brightness of the backlight of each region.

Figure 2:
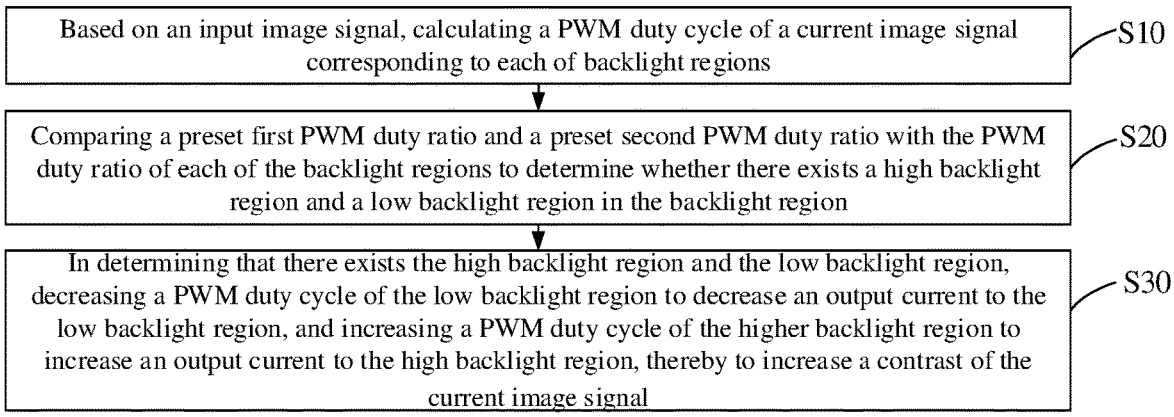
FIG. 2 is a schematic flowchart of a first embodiment of an image quality optimization method based on local dimming of the present invention.

Referring to FIG. 2, FIG. 2 is a schematic flowchart of a first embodiment of an image quality optimization method based on local dimming of the present invention. In this embodiment, the image quality optimization method based on local dimming includes the following steps:

step S10, based on the input image signal, calculating a PWM (pulse width modulation) duty cycle of a current image signal corresponding to each of backlight regions;

In this embodiment, PWM (Pulse Width Modulation) refers to a method of digitally encoding an analog signal level. Duty cycle refers to a proportion of an energizing time relative to a total time in one pulse cycle. By adjusting the PWM duty cycle, an amount of an output current or a value of an output voltage can be controlled.

In this embodiment, different encoded image signals input to the image display apparatus produce different displayed images, such as brightness, contrast, etc., and controls to the current or voltage of the backlight to achieve different image display effects are also different. That is, there exists certain mapping relationships between image signals and PWM duty cycles corresponding to each backlight region. Based on the mapping relationships, the PWM duty cycle corresponding to the current image signal in each backlight region can be calculated and obtained.

Optionally, in an embodiment, the PWM duty cycle corresponding to the current image signal in each of the backlight regions is calculated with the following manner:

(1) encoding and parsing the input image signal according to a division of the backlight regions to obtain an average gray value of each of the backlight regions;

(2) based on the average gray value of each backlight region, and mapping relationships between average gray values and backlight values, obtaining a backlight value of each backlight region;

(3) based on the backlight value of each backlight region, and preset mapping relationships between backlight values and PWM duty cycles, obtaining the PWM duty cycle corresponding to each backlight region.

The backlight value can be adjusted by adjusting the current or voltage, and the current or voltage can be adjusted by adjusting the PWM duty cycle. The mapping relationships between the average gray values and the backlight values, and the mapping relationships between the backlight values and the PWM duty cycles are preset according to relevant hardware design.

Step S20, comparing a preset first PWM duty cycle and a preset second PWM duty cycle with the PWM duty cycle of each of the backlight regions to determine whether there exists a high backlight region and a low backlight region in the backlight region;

In this embodiment, the PWM duty cycle is positively related to current flowing through light sources (such as lamp beads) in the backlight regions, and the current flowing through the lamp beads in the backlight regions is also positively related to a brightness of the backlight region. Therefore, based on the PWM duty cycle, it can distinguish bright fields and dark fields of the backlight regions.

In this embodiment, a backlight region whose PWM duty cycle is higher than the first PWM duty cycle is set to be a high backlight region (that is, a bright field), and a backlight region whose PWM duty cycle is lower than the second PWM duty cycle is set to be a low backlight region (that is, a dark field), where the first PWM duty cycle and the second PWM duty cycle are preset according to the hardware design of the backlight regions and the contrast requirements that displayed images need to meet.

Step S30, in determining that there exists the high backlight region and the low backlight region, decreasing a PWM duty cycle of the low backlight region to decrease an output current to the low backlight region, and increasing a PWM duty cycle of the higher backlight region to increase an output current to the high backlight region, so as to increase a contrast of the current image signal.

In this embodiment, when the input image signal meets a basic requirement for adjusting the contrast, that is, when there exists a high backlight region and a low backlight region in the backlight regions corresponding to the input image signal, to improve the contrast, it decreases the PWM duty cycle of the low backlight region to lower the output current to the low backlight region, thereby decreasing a brightness of the low backlight region, and it increases the PWM duty cycle of the high backlight region to increase the output current to the high backlight region, thereby increasing a brightness of the high backlight region. By decreasing the brightness of the low backlight region and increasing the brightness of the high backlight region, the contrast of the current image signal is increased.

The present embodiment improves the contrast by reducing the output current to the low backlight region and increasing the output current to the high backlight region to adjust the brightnesses of the backlight regions, and compensates the power of the high backlight region with the reduced power consumption of the low backlight region. In this way, the low power consumption of the whole device is achieved under the premise of high image contrast, which saves the costs of hardware light strips and power supplies, and ensures the stability of the hardware system of the device.

Figure 3:
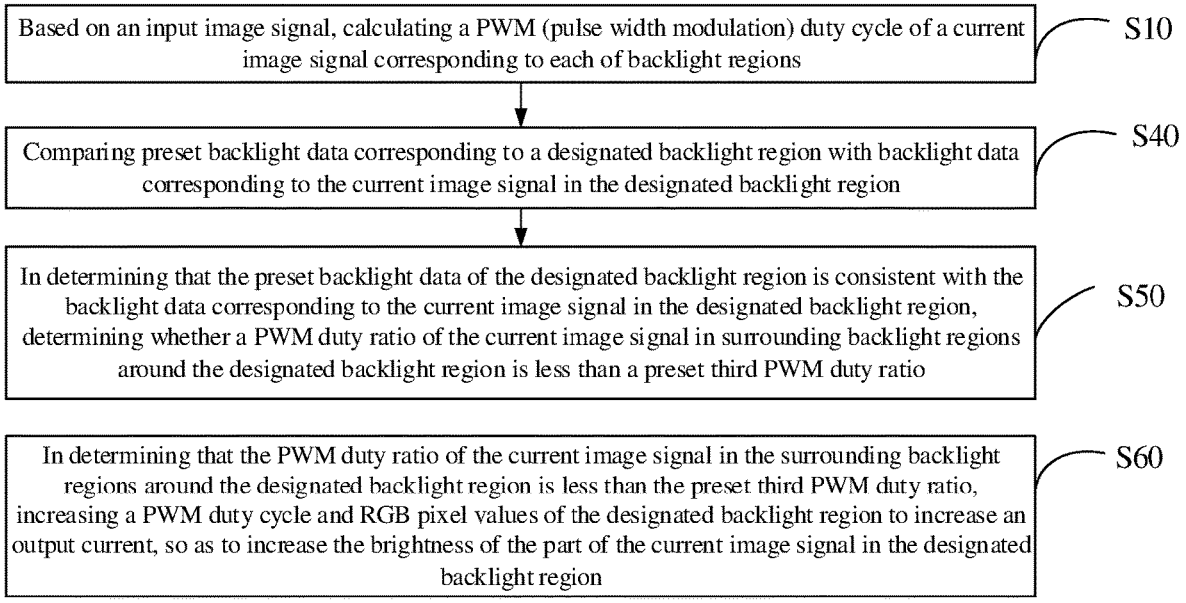
FIG. 3 is a schematic flowchart of a second embodiment of the image quality optimization method based on local dimming of the present invention.

Referring to FIG. 3, FIG. 3 is a schematic flowchart of a second embodiment of the image quality optimization method based on local dimming of the present invention. In order to further optimize the image quality, this embodiment also optimizes the image pixels. Therefore, after the above step S10, in this embodiment, the image quality optimization method based on local dimming includes the following steps:

step S40, comparing preset backlight data corresponding to a designated backlight region with backlight data corresponding to the current image signal in the designated backlight region.

Generally, for viewers, when watching a video, the viewers usually only pay attention to one or a few regions of the entire screen, such as the center region of the screen, or both the center region and the region right above the center region. Those regions are also usually core content regions of video frames, thus increasing the brightness of those regions will give the viewers a more direct viewing experience.

This embodiment presets the designated backlight region and the backlight data corresponding to the designated backlight region, and compares the backlight data corresponding to the designated backlight region with the backlight data of each video frame of video streams in each region. Based on a comparison result, it selects image frames (that is, image signals) whose image pixels can be optimized from the video streams. The backlight data includes a brightness of lamp beads in the designated backlight region, that is, in this embodiment, only a brightness of parts of the image frame that correspond to the designated backlight region and meet the set brightness requirement of the lamp beads is increased.

Step S50, in determining that the preset backlight data of the designated backlight region is consistent with the backlight data corresponding to the current image signal in the designated backlight region, determining whether a PWM duty cycle of the current image signal in surrounding backlight regions around the designated backlight region is less than a preset third PWM duty cycle;

in this embodiment, if the backlight data of a certain image frame of the video streams in the designated backlight region is the same as the preset backlight data, a quality of the image frame may be improved by adjusting the brightness.

In this embodiment, in order to make the brightness adjustment effect of the image more prominent, it is further determined whether the brightness of the current image signal in the surrounding backlight regions around the designated backlight region is dark. If the brightness of the current image signal in the surrounding backlight regions around the designated backlight region is dark, increasing the brightness of the designated backlight region will make the brightness effect of the image more prominent.

The third PWM duty cycle is preferably 0. At this time, the brightness of the designated backlight region increases but the brightness of the surrounding regions is 0, thereby facilitating heat dissipation of the lamp beads in the designated backlight region. The defining of the surrounding backlight regions of the designated backlight region is not limited. For example, a range of N times of a pixel distance around the designated backlight region is set as the surrounding backlight regions, where N is a positive integer greater than 0, such as N=100.

Step S60, in determining that the PWM duty cycle of the current image signal in the surrounding backlight regions around the designated backlight region is less than the preset third PWM duty cycle, increasing a PWM duty cycle and RGB pixel values of the designated backlight region to increase an output current, so as to increase the brightness of the part of the current image signal in the designated backlight region.

In this embodiment, if the backlight data of an image frame in the current video stream corresponding to the designated backlight region is consistent with the preset backlight data, and the PWM duty cycle of the surrounding backlight regions of the designated backlight region is less than the preset third PWM duty cycle, it increases the PWM duty cycle and RGB pixel values of the designated backlight region to increase the output current, thereby increasing the brightness of the current image signal.

Optionally, in an embodiment, in order to make the brightness effect the best, it increases the PWM duty cycle of the designated backlight region, thereby the output current of the designated backlight region exceeds the set current value, such as operating the lamp beads' current specification (such as a rated current); it further increases the RGB pixel values of the designated backlight region to the maximum RGB pixel value, so that the RGB pixel values of the designated backlight region matches the output current, such as increasing the R, G, B to 0XFF respectively, That is, adjusting the designated backlight region to white, thereby increasing the penetration of the backlight and improving the brightness of the image.

Further optionally, in an embodiment of the image quality optimization method based on local dimming of the present invention, the implementation of the above step S30: decreasing the PWM duty cycle of the low backlight region to decrease the output current and increasing the PWM duty cycle of the high backlight region to increase the output current includes the following process:

(1) decreasing the PWM duty cycle of the low backlight region and increasing the PWM duty cycle of the high backlight region;

in this embodiment, by adjusting the PWM duty cycles, the output current to the lamp beads in the backlight regions can be adjusted, which in turn affects the brightnesses of the backlight light sources (such as lamp beads), thereby adjusting the brightnesses of the backlight regions;

(2) based on a preset first mathematical relationship between PWM duty cycles and backlight powers, obtaining a decreased amount of backlight power of the low backlight region and an increased amount of backlight power of the high backlight region;

in this embodiment, the high backlight region is replenished with the decreased amount of backlight power of the low backlight region to increase the power of the high backlight region, that is, by means of power compensation, the contrast of the image quality is improved, but the power consumption of the backlight is not significantly increased, which saves cost in power and ensures the reliability of system hardware.

(3) In determining that the increased amount of backlight power in the high-backlight region meets a preset condition, based on a preset second mathematical relationship between the PWM duty cycles and output currents, calculating an output current corresponding to the low backlight region after the backlight power of the low-backlight region is decreased and an output current corresponding to the high backlight region after the backlight power of the high backlight region is increased;

In this embodiment, increasing the output current will increase the backlight power, that is, the heat of the backlight lamp beads will affect the stability of the device operation. Therefore, the increased amount of backlight power in the high backlight region needs to meet the preset condition which is: P3 is less than the sum of P1 and P2 and P3 is less than P4.

P1 is the difference between the total tolerated limit backlight power and the current total backlight power of all backlight regions, P2 is the decreased amount of backlight power of the low backlight region, P3 is the increased amount of backlight power in the high backlight region, and P4 is the tolerated limit backlight power of the high backlight region.

Among them, the total tolerated limit backlight power of all backlight regions and the tolerated limit backlight power of the high backlight region are constant values, and can be set in advance based on the hardware design requirements of the backlight regions. The current total backlight power, the decreased amount of backlight power of the low backlight region, and the increased amount of backlight power of the high backlight region can be calculated based on the first mathematical formula.

In this embodiment, in determining that the increased amount of backlight power of the high backlight region meets the preset condition, the corresponding output current after the power of the low backlight region is decreased, and the corresponding output current after the power of the high backlight region is increased can be calculated based on the second mathematical relationship between the preset PWM duty cycle and the output current.

Optionally, the first mathematical relationship is: $P=U_0*I_0*PWM/2$; the second mathematical relationship is: $I=I_0*PWM$;

in which, $I_0$, $U_0$ respectively represent the rated current and rated voltage of light sources of a single backlight region, and are constants; PWM represents the PWM duty cycle; I represents an actual output current of light sources of a single backlight region, P represents an actual power of light sources of a single backlight region, and is also referred as backlight power.

The invention also provides an image quality optimization device based on local dimming.

Figure 4:
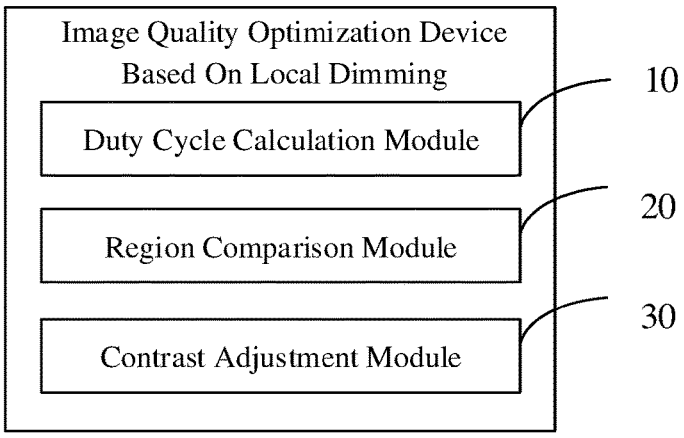
FIG. 4 is a schematic diagram of functional modules of a first embodiment of an image quality optimization device based on local dimming of the present invention.

Referring to FIG. 4, FIG. 4 is a schematic diagram of functional modules of a first embodiment of the image quality optimization device based on local dimming of the present invention. In this embodiment, the image quality optimization device based on local dimming includes:

a duty cycle calculation module 10 configured to calculate a PWM (pulse width modulation) duty cycle of a current image signal corresponding to each of backlight regions based on an input image signal;

In this embodiment, different encoded image signals input to the image display apparatus produce different displayed images, such as brightness, contrast, etc., and controls to the current or voltage of the backlight hardware to achieve different image display effects are also different. That is, there exists certain mapping relationships between image signals and PWM duty cycles corresponding to each backlight region. Based on the mapping relationships, the PWM duty cycle corresponding to the current image signal in each backlight region can be calculated and obtained.

Optionally, in an embodiment, the PWM duty cycle corresponding to the current image signal in each of the backlight regions is calculated with the following manner:

(1) encoding and parsing the input image signal according to a division of the backlight regions to obtain an average gray value of each of the backlight regions;

(2) based on the average gray value of each backlight region, and mapping relationships between average gray values and backlight values, obtaining a backlight value of each backlight region;

(3) based on the backlight value of each of the backlight regions, and preset mapping relationships between backlight values and PWM duty cycles, obtaining the PWM duty cycle corresponding to each of the backlight regions.

The backlight value can be adjusted by adjusting the current or voltage, and the current or voltage can be adjusted by adjusting the PWM duty cycle. The mapping relationships between the average gray values and the backlight values, and the mapping relationships between the backlight values and the PWM duty cycles are preset according to the relevant hardware design.

A region comparison module 20 is configured to compare a preset first PWM duty cycle and a preset second PWM duty cycle with the PWM duty cycle of the current image signal corresponding to each of the backlight regions to determine whether there exists a high backlight region and a low backlight region in the backlight regions;

In this embodiment, the PWM duty cycle is positively related to current flowing through lamp beads in the backlight regions, and the current flowing through the lamp beads in the backlight regions is also positively related to a brightness of the backlight region. Therefore, based on the PWM duty cycle, it can distinguish bright fields and dark fields of the backlight regions.

In this embodiment, a backlight region whose PWM duty cycle is higher than the first PWM duty cycle is set to be a high backlight region (that is, a bright field), and a backlight region whose PWM duty cycle is lower than the second PWM duty cycle is set to be a low backlight region (that is, a dark field), where the first PWM duty cycle and the second PWM duty cycle are preset according to the hardware design of the backlight regions and the contrast requirements that displayed images need to meet.

A contrast adjustment module 30 is configured to decrease a PWM duty cycle of the low backlight region to decrease an output current to the low backlight region, and increasing a PWM duty cycle of the higher backlight region to increase an output current to the high backlight region, in respond to the determination that there exists the high backlight region and the low backlight region, so as to increase a contrast of the current image signal.

In this embodiment, when the input image signal meets a basic requirement for adjusting the contrast, that is, when there exists a high backlight region and a low backlight region in the backlight regions corresponding to the input image signal, to improve the contrast, it decreases the PWM duty cycle of the low backlight region to lower the output current to the low backlight region, thereby decreasing a brightness of the low backlight region, and it increases the PWM duty cycle of the high backlight region to increase the output current to the high backlight region, thereby increasing a brightness of the high backlight region. By decreasing the brightness of the low backlight region and increasing the brightness of the high backlight region, the contrast of the current image signal is increased.

The present embodiment improves the contrast by reducing the output current to the low backlight region and increasing the output current to the high backlight region to adjust the brightnesses of the backlight regions, and compensates the power of the high backlight region with the reduced power consumption of the low backlight region. In this way, the low power consumption of the whole device is achieved under the premise of high image contrast, which saves the costs of hardware light strips and power supplies, and ensures the stability of the hardware system of the device.

Figure 5:
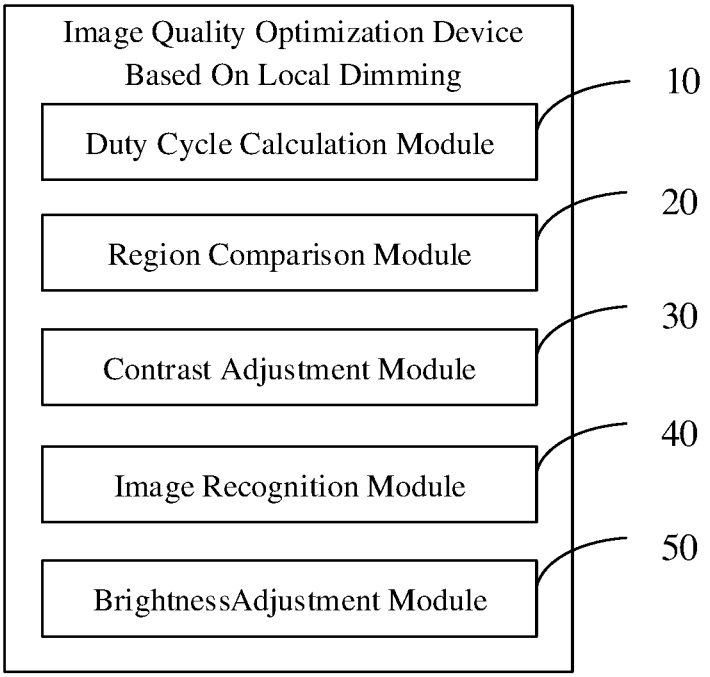
FIG. 5 is a schematic diagram of functional modules of a second embodiment of the image quality optimization device based on local dimming of the present invention.

Referring to FIG. 5, FIG. 5 is a schematic diagram of functional modules of a second embodiment of the image quality optimization device based on local dimming of the present invention. Based on the above embodiment, in this embodiment, the image quality optimization device based on local dimming further includes:

an image recognition module 40 configured to compare preset backlight data corresponding to a designated backlight region with backlight data corresponding to the current image signal in the designated backlight region, and determine whether a PWM duty cycle of the current image signal in surrounding backlight regions around the designated backlight region is less than a preset third PWM duty cycle in responding to a determination that the preset backlight data of the designated backlight region is consistent with the backlight data corresponding to the current image signal in the designated backlight region.

Generally, for viewers, when watching a video, the viewers usually only pay attention to one or a few regions of the entire screen, such as the center region of the screen, or both the center region and the region right above the center region. Those regions are also usually core content regions of video frames, thus increasing the brightness of those regions will give the viewers a more direct viewing experience.

This embodiment presets the designated backlight region and the backlight data corresponding to the designated backlight region, and compares the backlight data corresponding to the designated backlight region with the backlight data of each video frame of video streams in each region. Based on a comparison result, it selects image frames (that is, image signals) whose image pixels can be optimized from the video streams. The backlight data includes a brightness of lamp beads in the designated backlight region, that is, in this embodiment, only a brightness of parts of the image frame that correspond to the designated backlight region and meet the set brightness requirement of the lamp beads is increased.

A brightness adjustment module 50 is configured to increase a PWM duty cycle and RGB pixel values of the designated backlight region to increase an output current, so as to increase the brightness of the part of the current image signal in the designated backlight region, in responding to a determination that the PWM duty cycle of the current image signal in the surrounding backlight regions around the designated backlight region is less than the preset third PWM duty cycle.

In this embodiment, if the backlight data of a certain image frame of the video streams in the designated backlight region is the same as the preset backlight data, a quality of the image frame may be improved by adjusting the brightness.

In this embodiment, in order to make the brightness adjustment effect of the image more prominent, it is further determined whether the brightness of the current image signal in the surrounding backlight regions around the designated backlight region is dark. If the brightness of the current image signal in the surrounding backlight regions around the designated backlight region is dark, increasing the brightness of the designated backlight region will make the brightness effect of the image more prominent.

The third PWM duty cycle is preferably 0. At this time, the brightness of the designated backlight region increases but the brightness of the surrounding regions is 0, thereby facilitating heat dissipation of the lamp beads in the designated backlight region. The defining of the surrounding backlight regions of the designated backlight region is not limited. For example, a range of N times of a pixel distance around the designated backlight region is set as the surrounding backlight regions, where N is a positive integer greater than 0, such as N=100.

In this embodiment, if the backlight data of an image frame in the current video stream corresponding to the designated backlight region is consistent with the preset backlight data, and the PWM duty cycle of the surrounding backlight regions of the designated backlight region is less than the preset third PWM duty cycle, it increases the PWM duty cycle and RGB pixel values of the designated backlight region to increase the output current, thereby increasing the brightness of the current image signal.

Optionally, in an embodiment, in order to make the brightness effect the best, it increases the PWM duty cycle of the designated backlight region, thereby the output current of the designated backlight region exceeds the set current value, such as operating the lamp beads' current specification (such as a rated current); it further increases the RGB pixel values of the designated backlight region to the maximum RGB pixel value, so that the RGB pixel values of the designated backlight region matches the output current, such as increasing the R, G, B to 0XFF respectively, That is, adjusting the designated backlight region to white, thereby increasing the penetration of the backlight and improving the brightness of the image.

Figure 6:
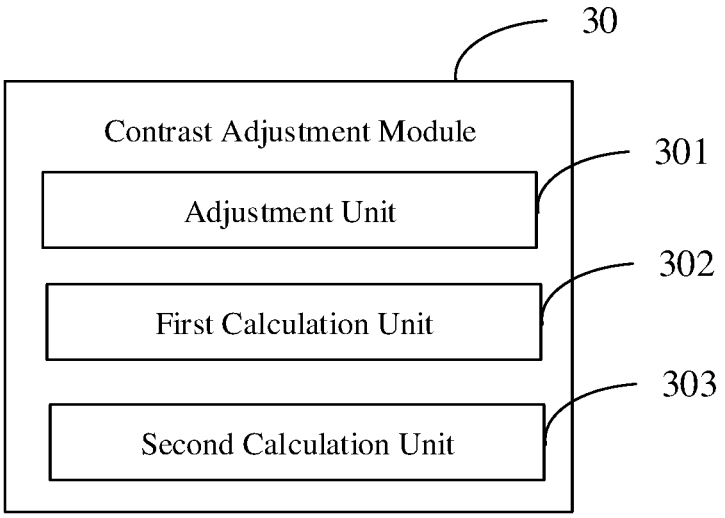
FIG. 6 is a schematic diagram of functional modules of an embodiment of a contrast adjustment module of FIG. 4.

Referring to FIG. 6, FIG. 6 is a schematic diagram of functional modules of an embodiment of the contrast adjustment module in FIG. 4. In this embodiment, the contrast adjustment module 30 includes:

an adjustment unit 301 configured to decrease the PWM duty cycle of the low backlight region and increase the PWM duty cycle of the high backlight region;

In this embodiment, by adjusting the PWM duty cycles, the output current of the lamp beads in the backlight regions can be adjusted, which in turn affects the brightness of the backlight light sources (such as the lamp beads), thereby adjusting the brightnesses of the backlight regions;

a first calculation unit 302 configured to obtain a decreased amount of backlight power of the low backlight region and an increased amount of backlight power of a high backlight region based on a preset first mathematical relationship between PWM duty cycles and backlight powers;

in this embodiment, the high backlight region is replenished with the decreased amount of backlight power of the low backlight region to increase the power of the high backlight region, that is, by means of power compensation, the contrast of the image quality is improved, but the power consumption of the backlight is not significantly increased, which saves cost in power and ensures the reliability of system hardware;

a second calculation unit 303 configured to calculate an output current corresponding to the low backlight region after the backlight power of the low-backlight region is decreased and an output current corresponding to the high backlight region after the backlight power of the high backlight region is increased based on a preset second mathematical relationship between the PWM duty cycles and output currents, in responding to a determination that the increased amount of backlight power in the high-backlight region meets a preset condition;

In this embodiment, increasing the output current will increase the backlight power, that is, the heat of the backlight lamp beads will affect the stability of the device operation. Therefore, the increased amount of backlight power in the high backlight region needs to meet the preset condition which is: P3 is less than the sum of P1 and P2 and P3 is less than P4.

P1 is the difference between the total tolerated limit backlight power and the current total backlight power of all backlight regions, P2 is the decreased amount of backlight power of the low backlight region, P3 is the increased amount of backlight power in the high backlight region, and P4 is the tolerated limit backlight power of the high backlight region.

Among them, the total tolerated limit backlight power of all backlight regions and the tolerated limit backlight power of the high backlight region are constant values, and can be set in advance based on the hardware design requirements of the backlight regions. The current total backlight power, the decreased amount of backlight power of the low backlight region, and the increased amount of backlight power of the high backlight region can be calculated based on the first mathematical formula.

In this embodiment, in determining that the increased amount of backlight power of the high backlight region meets the preset condition, the corresponding output current after the power of the low backlight region is decreased, and the corresponding output current after the power of the high backlight region is increased can be calculated based on the preset second mathematical relationship between the PWM duty cycles and the output currents.

Optionally, the first mathematical relationship is: $P=U_0*I_0*PWM/2$; the second mathematical relationship is: $I=I_0*PWM$;

in which, $I_0$, $U_0$ respectively represent the rated current and rated voltage of light sources of a single backlight region, and are constants; PWM represents the PWM duty cycle; I represents an actual output current of light sources of a single backlight region, P represents an actual power of light sources of a single backlight region, and is also referred as backlight power.

The invention also provides a computer-readable storage medium.

In this embodiment, an image quality optimization program based on local dimming is stored on the computer-readable storage medium, and the image quality optimization program based on local dimming is implemented by a processor to realize an image quality optimization method based on local dimming as described in any of the above embodiments.

Through the description of the above embodiments, those skilled in the art can clearly understand that the methods in the above embodiments can be implemented by means of software plus a necessary general hardware platform, and of course, can also be implemented by hardware, but in many cases the former is better. Based on this understanding, the technical solution of the present invention can be embodied in the form of a software product in essence or part that contributes to the existing technology, and the computer software product is stored in a storage medium (such as a ROM/RAM), and includes several instructions to enable a terminal (which may be a mobile phone, a computer, a server, a network device, or the like) to execute the method described in each embodiment of the present invention.

The embodiments of the present invention have been described above with reference to the drawings, but the present invention is not limited to the above-mentioned specific embodiments. The above-mentioned specific embodiments are only schematic and are not restrictive. Under the enlightenment of the present invention, more embodiments can be made without departing from the scope of the present invention and the scope of the claims. Any equivalent structure or equivalent process transformation made based on the description and drawings of the present invention, or the invention directly or indirectly applied in other related technical fields, are all covered by the protection of the present invention.

What is claimed is:

1. An image quality optimization method based on local dimming, comprising the following steps:

based on an input image signal, calculating a PWM duty cycle of a current image signal corresponding to each backlight region;

comparing a preset first PWM duty cycle and a preset second PWM duty cycle with each PWM duty cycle of the current image signal corresponding to each backlight region to determine whether there exists a high backlight region and a low backlight region in backlight regions;

in determining that there exists the high backlight region and the low backlight region, decreasing a PWM duty cycle of the low backlight region to decrease an output current to the low backlight region, and increasing a PWM duty cycle of the high backlight region to increase an output current to the high backlight region, thereby increasing a contrast of the current image signal;

wherein, after "based on an input image signal, calculating a PWM duty cycle of a current image signal corresponding to each backlight region", the method further comprises:

comparing preset backlight data of a designated backlight region with backlight data corresponding to the current image signal in the designated backlight region;

in determining that the preset backlight data of the designated backlight region is consistent with the backlight data corresponding to the current image signal in the designated backlight region, determining whether a PWM duty cycle of the current image signal in surrounding backlight regions around the designated backlight region is less than a preset third PWM duty cycle;

in determining that the PWM duty cycle of the current image signal in the surrounding backlight regions around the designated backlight region is less than the preset third PWM duty cycle, increasing a PWM duty cycle and RGB pixel values of the designated backlight region to increase an output current to the designated backlight region, thereby to increase the brightness of the current image signal.

2. The image quality optimization method based on local dimming as claimed in claim 1, wherein, "decreasing a PWM duty cycle of the low backlight region to decrease an output current to the low backlight region, and increasing a PWM duty cycle of the high backlight region to increase an output current to the high backlight region" comprises:

decreasing the PWM duty cycle of the low backlight region and increasing the PWM duty cycle of the high backlight region;

based on a preset first mathematical relationship between PWM duty cycles and backlight powers, obtaining a decreased amount of backlight power of the low backlight region and an increased amount of backlight power of the high backlight region;

in determination that the increased amount of backlight power of the high-backlight region meets a preset condition, based on a preset second mathematical relationship between the PWM duty cycles and output currents, calculating an output current corresponding to the low backlight region after the backlight power of the low-backlight region is decreased and an output current corresponding to the high backlight region after the backlight power of the high backlight region is increased;

wherein, a difference between a total tolerated limit backlight power and a current total backlight power of all the backlight regions is P1, the decreased amount of backlight power of the low backlight region is P2, the increased amount of backlight power of the high backlight region is P3, and a tolerated limit backlight power of the high backlight region is P4, the preset condition is that: P3 is less than the sum of P1 and P2 and P3 is less than P4.

3. The image quality optimization method based on local dimming as claimed in claim 2, wherein, "based on an input image signal, calculating a PWM duty cycle of a current image signal corresponding to each backlight region" comprises:

coding and parsing the input image signal according to a division of the backlight regions to obtain an average gray value of each backlight region;

based on the average gray value of each backlight region, and mapping relationships between average gray values and backlight values, obtaining a backlight value of each backlight region;

based on the backlight value of each backlight region and preset mapping relationships between the backlight values and PWM duty cycles, obtaining a PWM duty cycle corresponding to each backlight region.

4. The image quality optimization method based on local dimming as claimed in claim 1, wherein, "increasing a PWM duty cycle and RGB pixel values of the designated backlight region" comprises:

increasing the PWM duty cycle of the designated backlight region, thereby the output current to the designated backlight region exceeding a set current value;

increasing the RGB pixel values of the designated backlight region to the maximum RGB pixel values, thereby the RGB pixel values of the designated backlight region matching the output current to the designated backlight region.

5. The image quality optimization method based on local dimming as claimed in claim 1, wherein, "based on an input image signal, calculating a PWM duty cycle of a current image signal corresponding to each backlight region" comprises:

coding and parsing the input image signal according to a division of the backlight regions to obtain an average gray value of each backlight region;

based on the average gray value of each backlight region, and mapping relationships between average gray values and backlight values, obtaining a backlight value of each backlight region;

based on the backlight value of each backlight region and preset mapping relationships between backlight values and PWM duty cycles, obtaining a PWM duty cycle corresponding to each backlight region.

6. An image display apparatus, wherein the image display apparatus comprises a memory, a processor, and an image quality optimization program based on local dimming stored in the memory and executable by the processor, when the image quality optimization program based on local dimming is executed by the processor, the following steps are carried out:

based on an input image signal, calculating a PWM duty cycle of a current image signal corresponding backlight region;

comparing a preset first PWM duty cycle and a preset second PWM duty cycle with each PWM duty cycle of the current image signal corresponding to each region to determine whether there exists a high backlight region and a low backlight region in backlight regions;

in determining that there exists the high backlight region and the low backlight region, decreasing a PWM duty cycle of the low backlight region to decrease an output current to the low backlight region, and increasing a PWM duty cycle of the high backlight region to increase an output current to the high backlight region, thereby increasing a contrast of the current image signal;

wherein, after "based on an input image signal, calculating a PWM duty cycle of a current image signal corresponding to each backlight region", when the image quality optimization program based on local dimming is executed by the processor, the following steps are also carried out:

comparing preset backlight data of a designated backlight region with backlight data corresponding to the current image signal in the designated backlight region;

in determining that the preset backlight data of the designated backlight region is consistent with the backlight data corresponding to the current image signal in the designated backlight region, determining whether a PWM duty cycle of the current image signal in surrounding backlight regions around the designated backlight region is less than a preset third PWM duty cycle;

in determining that the PWM duty cycle of the current image signal in the surrounding backlight regions around the designated backlight region is less than the preset third PWM duty cycle, increasing a PWM duty cycle and RGB pixel values of the designated backlight region to increase an output current to the designated backlight region, thereby to increase the brightness of the current image signal.

7. The image display apparatus as claimed in claim 6, wherein, "decreasing a PWM duty cycle of the low backlight region to decrease an output current to the low backlight region, and increasing a PWM duty cycle of the high backlight region to increase an output current to the high backlight region" comprises:

decreasing the PWM duty cycle of the low backlight region and increasing the PWM duty cycle of the high backlight region;

based on a preset first mathematical relationship between PWM duty cycles and backlight powers, obtaining a decreased amount of backlight power of the low backlight region and an increased amount of backlight power of the high backlight region;

in determination that the increased amount of backlight power of the high-backlight region meets a preset condition, based on a preset second mathematical relationship between the PWM duty cycles and output currents, calculating an output current corresponding to the low backlight region after the backlight power of the low-backlight region is decreased and an output current corresponding to the high backlight region after the backlight power of the high backlight region is increased;

wherein, a difference between a total tolerated limit backlight power and a current total backlight power of all the backlight regions is P1, the decreased amount of backlight power of the low backlight region is P2, the increased amount of backlight power of the high backlight region is P3, and a tolerated limit backlight power of the high backlight region is P4, the preset condition is that: P3 is less than the sum of P1 and P2 and P3 is less than P4.

8. The image display apparatus as claimed in claim 6, wherein, "increasing a PWM duty cycle and RGB pixel values of the designated backlight region" comprises:

increasing the PWM duty cycle of the designated backlight region, thereby the output current to the designated backlight region exceeding a set current value;

increasing the RGB pixel values of the designated backlight region to the maximum RGB pixel values, thereby the RGB pixel values of the designated backlight region matching the output current to the designated backlight region.

9. The image display apparatus as claimed in claim 8, wherein, "based on an input image signal, calculating a PWM duty cycle of a current image signal corresponding to each backlight region" comprises:

coding and parsing the input image signal according to a division of the backlight regions to obtain an average gray value of each backlight region;

based on the average gray value of each backlight region, and mapping relationships between average gray values and backlight values, obtaining a backlight value of each backlight region;

based on the backlight value of each backlight region and preset mapping relationships between backlight values and PWM duty cycles, obtaining a PWM duty cycle corresponding to each backlight region.

10. A non-transitory computer readable storage medium storing an image quality optimization program based on local dimming, wherein, when the image quality optimization program based on local dimming is executed by a processor, the following steps are carried out:

based on an input image signal, calculating a PWM duty cycle of the image signal corresponding to each backlight region;

comparing a preset first PWM duty cycle and a preset second PWM duty cycle with each PWM duty cycle of the current image signal corresponding to each backlight region to determine whether there exists a high backlight region and a low backlight region in backlight regions;

in determining that there exists the high backlight region and the low backlight region, decreasing a PWM duty cycle of the low backlight region to decrease an output current to the low backlight region, and increasing a PWM duty cycle of the high backlight region to increase an output current to the high backlight region, thereby increasing a contrast of the image signal;

wherein, after "based on an input image signal, calculating a PWM duty cycle of a current image signal corresponding to each backlight region", when the image quality optimization program based on local dimming is executed by the processor, the following steps are also carried out:

comparing preset backlight data of a designated backlight region with backlight data corresponding to the current image signal in the designated backlight region;

in determining that the preset backlight data of the designated backlight region is consistent with the backlight data corresponding to the current image signal in the designated backlight region, determining whether a PWM duty cycle of the current image signal in surrounding backlight regions around the designated backlight region is less than a preset third PWM duty cycle;

in determining that the PWM duty cycle of the current image signal in the surrounding backlight regions around the designated backlight region is less than the preset third PWM duty cycle, increasing a PWM duty cycle and RGB pixel values of the designated backlight region to increase an output current to the designated backlight region, thereby to increase the brightness of the current image signal.

11. The non-transitory computer readable storage medium as claimed in claim 10, wherein, "decreasing a PWM duty cycle of the low backlight region to decrease an output current to the low backlight region, and increasing a PWM duty cycle of the high backlight region to increase an output current to the high backlight region" comprises:

decreasing the PWM duty cycle of the low backlight region and increasing the PWM duty cycle of the high backlight region;

based on a preset first mathematical relationship between PWM duty cycles and backlight powers, obtaining a decreased amount of backlight power of the low backlight region and an increased amount of backlight power of the high backlight region;

in determination that the increased amount of backlight power of the high-backlight region meets a preset condition, based on a preset second mathematical relationship between the PWM duty cycles and output currents, calculating an output current corresponding to the low backlight region after the backlight power of the low-backlight region is decreased and an output current corresponding to the high backlight region after the backlight power of the high backlight region is increased;

wherein, a difference between a total tolerated limit backlight power and a current total backlight power of all the backlight regions is P1, the decreased amount of backlight power of the low backlight region is P2, the increased amount of backlight power of the high backlight region is P3, and a tolerated limit backlight power of the high backlight region is P4, the preset condition is that: P3 is less than the sum of P1 and P2 and P3 is less than P4.

12. The non-transitory computer readable storage medium as claimed in claim 10, wherein, "increasing a PWM duty cycle and RGB pixel values of the designated backlight region" comprises:

increasing the PWM duty cycle of the designated backlight region, thereby the output current to the designated backlight region exceeding a set current value;

increasing the RGB pixel values of the designated backlight region to the maximum RGB pixel values, thereby the RGB pixel values of the designated backlight region matching the output current to the designated backlight region.

13. The non-transitory computer readable storage medium as claimed in claim 10, wherein, "based on an input image signal, calculating a PWM duty cycle of a current image signal corresponding to each backlight region" comprises:

coding and parsing the input image signal according to a division of the backlight regions to obtain an average gray value of each backlight region;

based on the average gray value of each backlight region, and mapping relationships between average gray values and backlight values, obtaining a backlight value of each backlight region;

based on the backlight value of each backlight region and preset mapping relationships between backlight values and PWM duty cycles, obtaining a PWM duty cycle corresponding to each backlight region.

* * * * *